United States Patent [19]

Baugh

[11] 4,067,062

[45] Jan. 10, 1978

[54] HYDRAULIC SET TUBING HANGER

[75] Inventor: Benton F. Baugh, Houston, Tex.

[73] Assignee: Vetco Offshore Industries, Inc.

[21] Appl. No.: 695,265

[22] Filed: June 11, 1976

[51] Int. Cl.[2] ..... E21B 23/00; E21B 33/03

[52] U.S. Cl. ..... 166/125; 166/85; 166/208; 166/212

[58] Field of Search ..... 166/85, 125, 208, 212, 166/.6

[56] References Cited

U.S. PATENT DOCUMENTS

| | | | |
|---|---|---|---|
| 3,321,217 | 5/1967 | Ahlstone | 166/.6 |
| 3,543,847 | 12/1970 | Haeber | 166/208 |
| 3,688,841 | 9/1972 | Baugh | 166/85 |
| 3,693,714 | 9/1972 | Baugh | 166/85 |
| 3,807,497 | 4/1974 | Baugh | 166/85 |
| 3,924,678 | 12/1975 | Ahlstone | 166/208 |

*Primary Examiner*—James A. Leppink
*Attorney, Agent, or Firm*—Pravel, Wilson & Gambrell

[57] ABSTRACT

A tubing hanger for suspending multiple strings of tubing in a subsea wellhead or casing hanger upon being lowered from the drill vessel into a properly oriented seating position in the casing hanger. The tubing hanger is releasably secured to the casing hanger by hydraulic manipulation of the running tool after the tubing hanger has been oriented in the casing hanger. Thereafter, by further hydraulic manipulation, the running tool is released from the hydraulic set tubing hanger for retrieval to the drill ship. The running tool may later be returned and connected to the tubing hanger and, by further manipulation of the running tool, the hanger is disconnected from the casing hanger and elevated to the drill ship.

11 Claims, 12 Drawing Figures

222
18
42
43
41
44
45
40
28
24
C
12
C'
35
36
31
20
G
33
30
24
16
16
14
W
F

HYDRAULIC SET TUBING HANGER

BACKGROUND OF THE INVENTION

In the past various types of tubing hangers have been provided which were landed in the casing hanger and which carried or suspended multiple strings of tubing in wells in the ocean floor. Examples of these devices can be found in U.S. Pat. No. 3,693,714 for "Tubing Hanger Orienting Apparatus and Pressure Energized Sealing Device", U.S. Pat. No. 3,688,841 for "Orienting Tubing Hanger Apparatus" and U.S. Pat. No. 3,807,497 for "Orienting Tubing Hanger Apparatus Through Which Side Pocket Mandrels Can Pass". However, these devices required a running tool employing a dart for operation which restricted the bore of the tubing hanger, whereas the present invention provides a running tool allowing full bore tubing access during running. Further, the present tool also provides means for controlling downhole safety valves during both running and landing operations.

SUMMARY OF THE INVENTION

The present invention comprises a hydraulic set tubing hanger having a releasable running tool for hydraulically setting and retrieving the tubing hanger with multiple strings of tubing supported therefrom in a subsea well. The tubing hanger running tool provides full bore access in the tubing strings during the running operation and also provides means to operate a downhole safety valve during running and landing operations. Further, the running tool provides means for retrieving the tubing hanger either by straight mechanical pull or by hydraulic pressure.

DESCRIPTION OF THE PREFERRED EMBODIMENT

Figures 1, 1A:
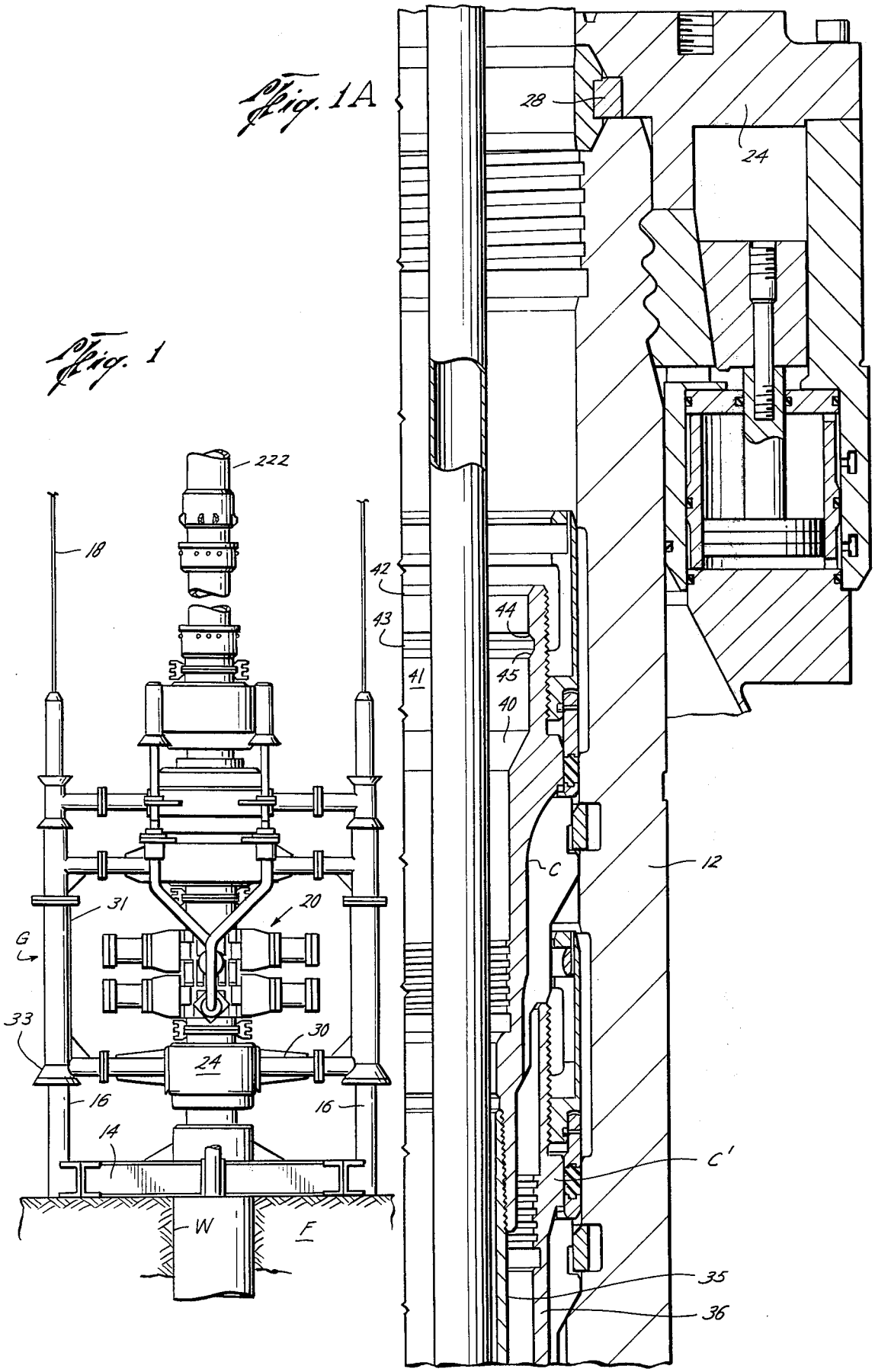
FIG. 1 is a side elevation view of a subsea system used in drilling and completing of underwater wells.
FIG. 1A is a longitudinal fragmentary section through a portion of FIG. 1.

As illustrated in the drawings (FIGS. 1, 1A, 2 and 3), a multiple tubing string hanger T is to be set and sealed in a casing hanger C that is supported in a casing hanger body 12 that supports casing which extends into the wellbore W drilled in a formation underlying the ocean floor F.

As well-known, the housing 12 and casing hangers C, C′ and possibly others supported thereby, are secured to a guidance structure G in a known manner. As is customary, such guidance structure normally includes a base 14 having guide posts 16 which extend vertically upwardly from the corners of the base and which have cables 18 secured thereto that extends upwardly to the drill vessel at the water surface (not shown). A blowout preventer stack 20 is normally disposed at the lower end of the marine riser stack 22 which also extends upwardly to the drilling vessel at the surface of the water thereabove. This blowout preventer stack 20 is connected by a connector 24 which is attached to the casing hanger body 12. The connector 24 may be of any suitable type, for example, such as the hydraulic connector illustrated and described in U.S. Pat. No. 3,321,217. It will be appreciated that a suitable seal 28 will be provided between the connector 24 and the upper end of the housing 12 and a suitable seal will be provided between the blowout preventer stack 20 and the connector 24.

It will also be appreciated that the connector 24, which is secured by its guide frame 30 to the guide sleeves 31, is moved downwardly with the blowout preventer stack 20 along the guide lines 18. As shown, the guides 31 are provided with flared or funnel-shaped lower ends 33 which facilitate guidance along the lines 18 and over the upstanding guide post 16.

Figures 2, 2A:
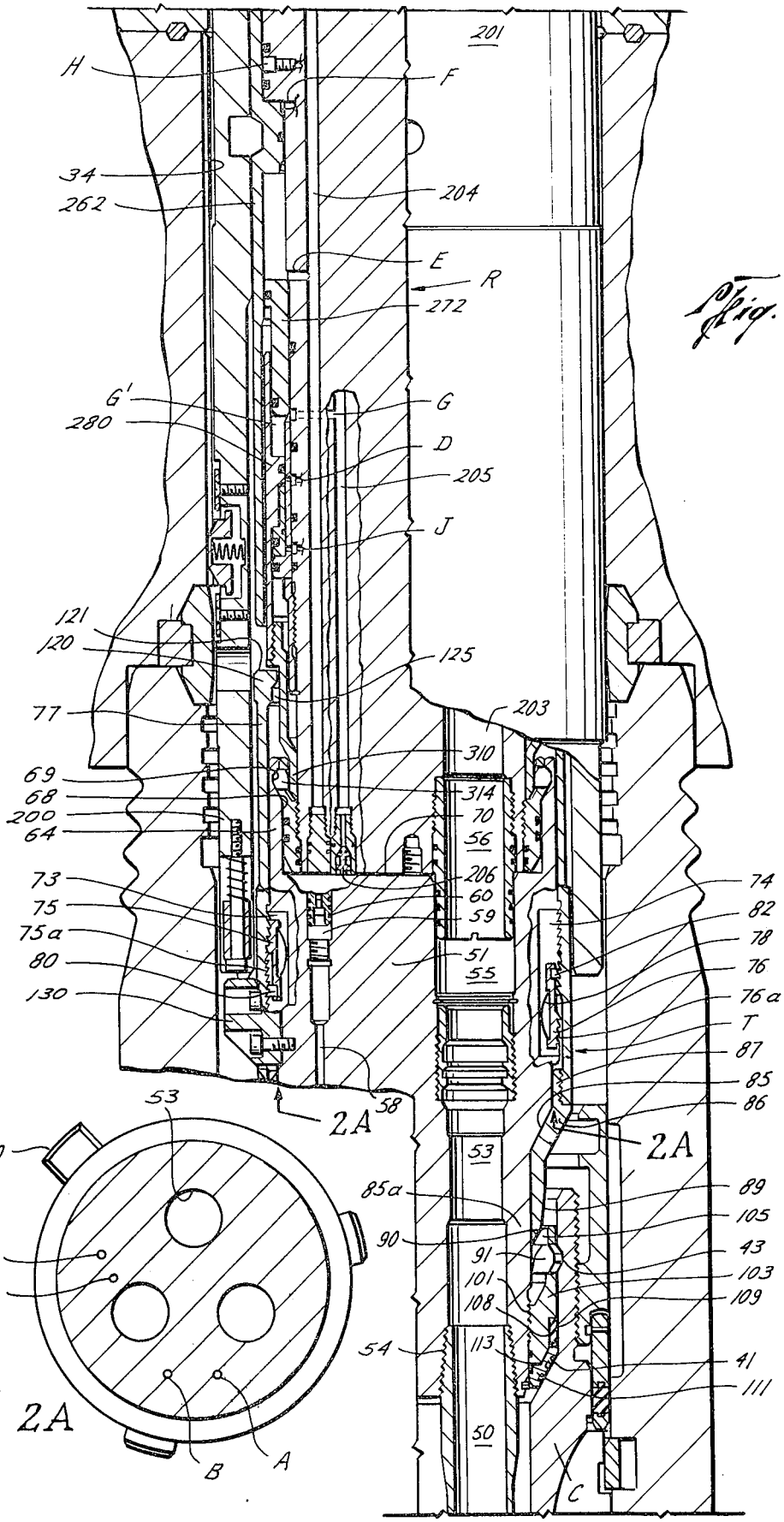
FIG. 2 is an enlarged vertical section through the apparatus embodying the invention and which is to be disposed in a wellhead casing hanger apparatus with the running tool locked in the tubing hanger and the tubing hanger landed but not locked in the casing hanger.
FIG. 2A is a sectional view taken on line 2A—2A of FIG. 2.

As seen in FIG. 2 of the drawings, the connector 24 has a longitudinally extending orientation slot or groove 34 that is provided for orienting the running tool which carries the tubing hanger T so as to initially orient the tubing hanger T and its longitudinally extending passages extending therethrough in a known orientation with respect to the groove 34. This necessarily orients the tubing hanger T with respect to the guide lines, guide post and entire guide structure G.

As shown in FIG. 1A of the drawings, a plurality of concentric casing strings 35 and 36 are connected at their upper ends to the concentric casing hangers C and C′ which are arranged in a stacked relationship and secured with appropriate seals to the casing hanger body 12. As will be described herein, the tubing hanger T will seat and be sealed against the casing hanger C which is provided with an inwardly and downwardly tapering hanger seat 40. Also, as shown, the casing hanger C is provided with a cylindrical sealing surface 41 which extends upwardly from the upper edge of the tapered seat 40 to an upper flared end 42 and which is also provided with a circumferentially extending lock groove 43 having facing sloped sides 44 and 45.

As shown in FIG. 2, as the tubing hanger T is lowered into position relative to the casing hanger C it is supported with one or more strings of tubing 50 by the tubing hanger running tool R. Such tubing hanger comprises a generally cylindrical body 51 having a plurality of longitudinally extending tubing passages 53 extending therethrough. Generally there are two or three such passages in a multi string tubing hanger; however, the number of the tubing passages may vary. Each tubing passages 53 in the tubing hanger normally has a threaded lower end 54 for threadedly connecting the tubing 50 thereto. The upper end of the passage 53 is provided with a counter bore 55 for receiving and sealing with a seal sub 56.

Similarly, the central body 51 also has a plurality of control line passages, such as 58 extending therethrough, to connect control lines to the tubing hanger to provide for various functions, such as a downhole ball valve (not shown). It will be understood that passage 58 is representative of several downhole control lines, such as A and B shown in FIG. 2A. The control line passages are provided with cylindrical seal surfaces 59 for receiving a plug or seal sub 60 which may be inserted therein. The lower ends 62 of the control line passages 58 are provided with a threaded connection for connecting control lines which extend beneath the tubing hanger body 51.

The cylindrical body 51 has a counterbore at its upper end which forms a circumferentially extending annular skirt 64 which has a cylindrical inner seal surface 68 and a circumferentially extending lock groove 69 which extends around the annular skirt near its upper end for receiving the locking dogs on the running tool R as will be described hereinafter. The counterbore also forms a flat central face 70 for receiving the lower end of the running tool or its extension as will be described.

The cylindrical body 51 is provided with external recesses 73 and 74 for receiving spring loaded shear dogs 75 and 76, respectively, which are held in position inside an upper actuator body 77. As shown in FIG. 2, the shear dog 75 is positioned near the upper end of the recess 73 and the shear dog 76 is shown positioned near the lower end of the slot or recess 74. The shear dogs have springs 78 which urge them outwardly into engagement with the adjacent inner surface of the upper actuator body 77. As shown, the shear dog 75 is provided with teeth **75*a* that point upwardly and the corresponding teeth on the adjacent inner surface of the upper actuator body face downwardly. Thus, downward movement of the upper actuator body 77 will cause the teeth to engage and the shear dog 75 to move downward shearing the transverse pin 80**.

Similarly, the teeth **76*a* on the actuator dog 76 are pointed downwardly and the mating teeth on the adjacent inner surface of the upper actuator body 77 are pointed downwardly so that a downward stroke of the upper actuator body will cause the teeth on the actuator body to depress the spring 78 and allow such teeth to ratchet over the downward facing teeth 76*a* on the dog 76. However, when the upper actuator body 77 is stroked upwardly, the teeth will engage and the dog 76 will move upward causing the transverse pin 82** to be sheared.

It will be appreciated that the tubing hanger of the present invention is provided with shear dogs which positively retain the actuator body in both the upper and lower positions on the inner body 51.

As shown, the cylindrical body 51 also has an inwardly and downwardly tapered circumferential shoulder 85 connecting the lower cylindrical end **85*a* to the upper cylindrical body 51**.

A lower actuator body 86 encircles or surrounds the inner body 51. The lower actuator body has a cylindrical upper body portion 87 above a tapered portion **86*a* and a lower externally tapered portion 89 depending below the tapered mid-portion 86*a***.

Figure 3:
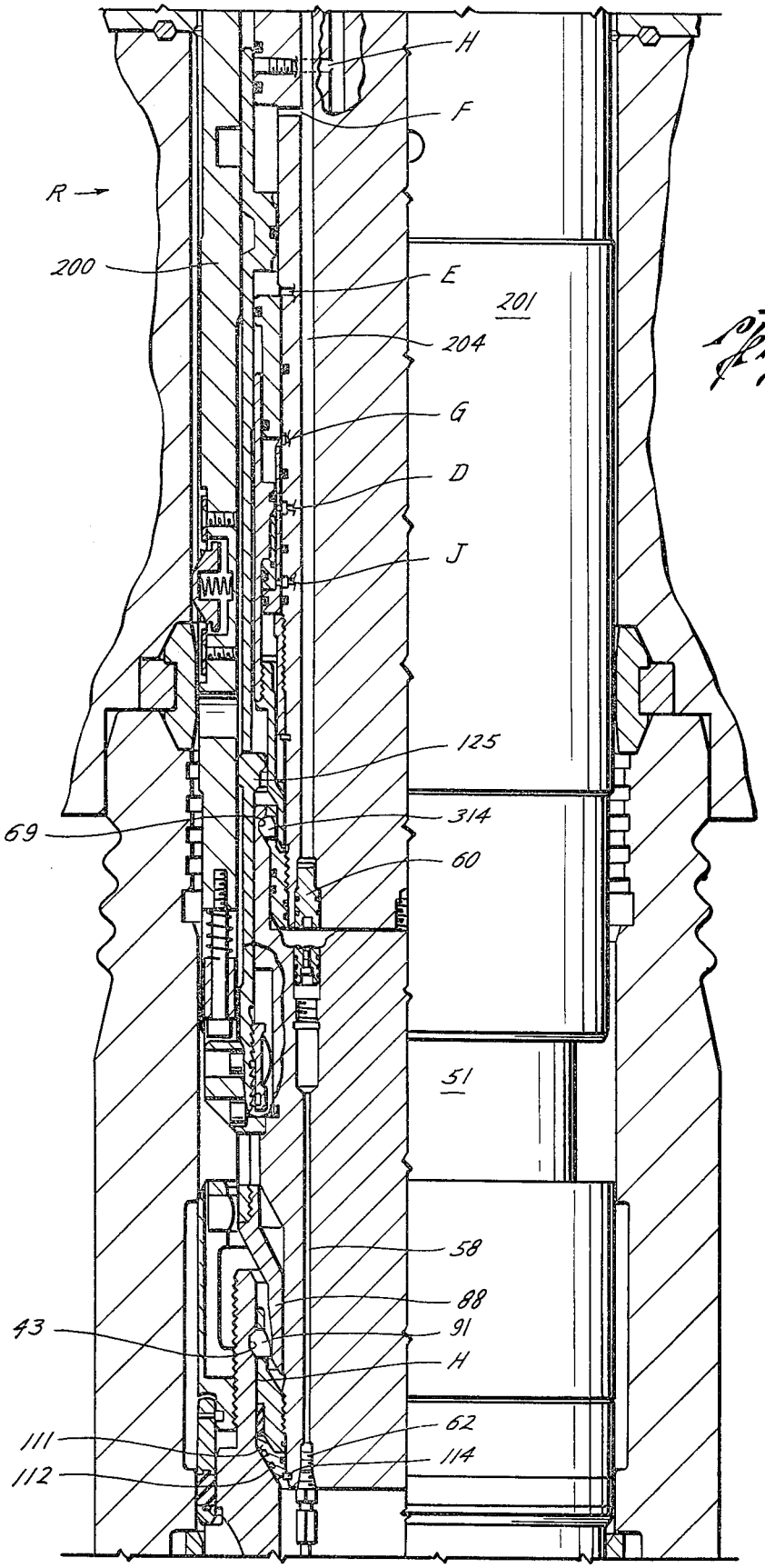
FIG. 3 is a fragmentary view of an enlarged vertical section showing the tubing hanger in the locked in position in the casing hanger.

A sharply inwardly and downwardly tapered tip 90 is formed at the lower end of the lower portion 89 which facilitates insertion behind the lock dogs 91 to expand them outwardly into the circumferential lock groove 43 in the casing hanger C as shown in FIG. 3.

The body 51 is provided with threads 101 at its lower end for threadedly securing the dog body 103 thereto. Such a dog body 103 surrounds the lower end of the tubing hanger body 51 and carries the dogs 91. Such dog body is also provided with an upwardly facing annular skirt 105 that surrounds the lower end of the tapered dog locks 89 and provides an annular space for receiving such dog locks when moved to lock the dogs 91. The dog body 103 also has an external groove 108 which receives a hanger seal 109 which seals with the cylindrical seal surface 41 in the casing hanger C. A landing ring 111 having an inwardly and downwardly tapered surface with a packing gasket or seal material 112 therein for sealingly engaging the tapered seat 40 in the casing hanger C. A rotating washer 113 is provided between the bottom of the dog body 103 and the landing ring 111. The landing ring 111 is retained on the lower end of the cylindrical housing 51 by means of a retaining ring 114 or other suitable retaining means.

The upper actuator body 77 is provided with an upset or ring portion 120 at the upper end with a flat shoulder 121 at the top of the upper actuator body for receiving a downward stroke from the running tool R as will be described hereinafter. Also, the upset forms an inwardly projecting lip or flange 123 having a circumferential internal groove or recess 124 therebelow for receiving locking dogs as will be described hereinafter.

Also, as shown on FIG. 2A, the body 51 is provided with an orienting key 130 which is used for orienting the running tool on re-entry for retrieval of the tubing hanger as well as a pair of landing dog keys 132 which are spaced approximately 120° from each other.

Figure 4:
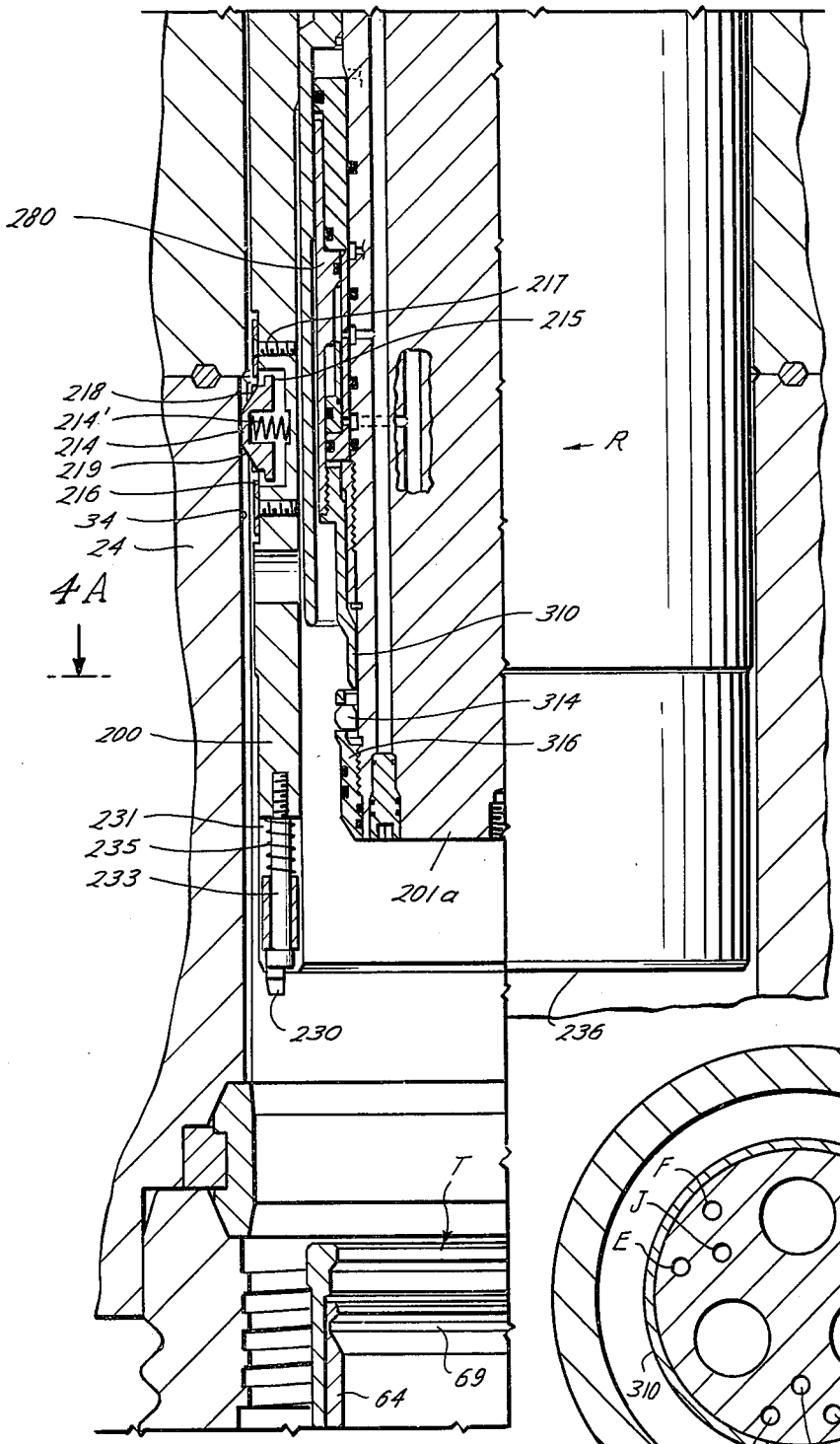
FIG. 4 is a fragmentary view of an enlarged vertical section showing the running tool disconnected from the tubing hanger which is locked in the casing hanger.
Figure 5:
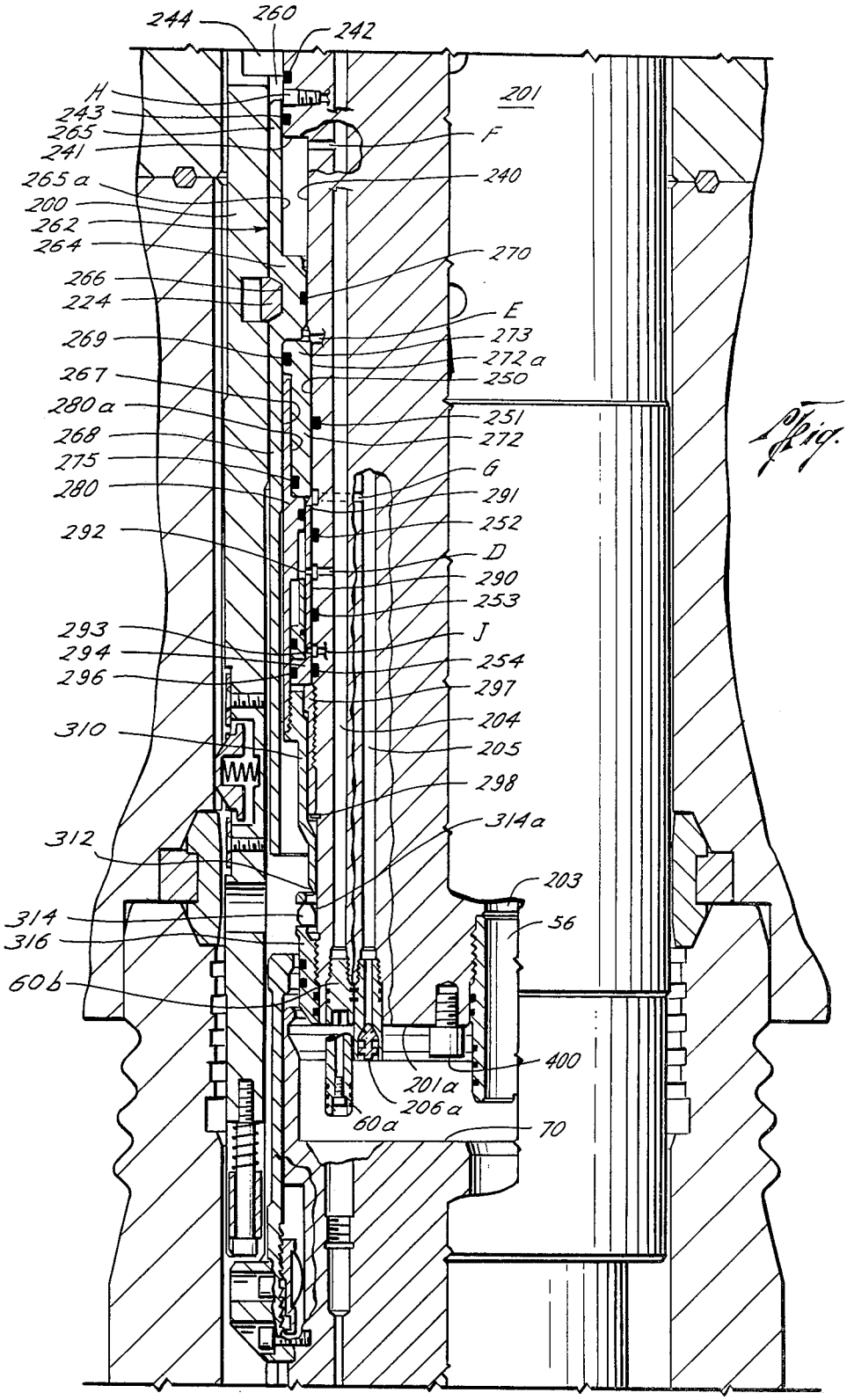
FIG. 5 is a fragmentary view of an enlarged vertical section showing the running tool oriented but not locked into the locked in tubing hanger.

As best seen in FIGS. 3, 4 and 5 of the drawings, the running tool R comprises a longitudinally extending outer sleeve 200 which surrounds an inner cylindrical body 201. Such inner body has a plurality of longitudinally extending tubing passages, such as the passage 203, which is connected by the seal sub 56 to the passage 53 as shown in FIG. 2. Also, the inner body 201 includes a plurality of longitudinally extending control line passages, such as 204, which connect to the control line passage 58 in the tubing hanger T by extension sub 60. The central body also has a control passage 205 which connects with port G. The lower end of such passage 205 is provided with a check valve 206 which is closed when it engages the face 70 in the tubing hanger, thus permitting fluid pressure to be applied to move the primary dog piston 203 as will be described hereinafter. Unless the check valve 206 is properly seated on the face 70, the primary dog piston cannot be moved to latch the tubing hanger T by the dogs 69.

Figure 8:
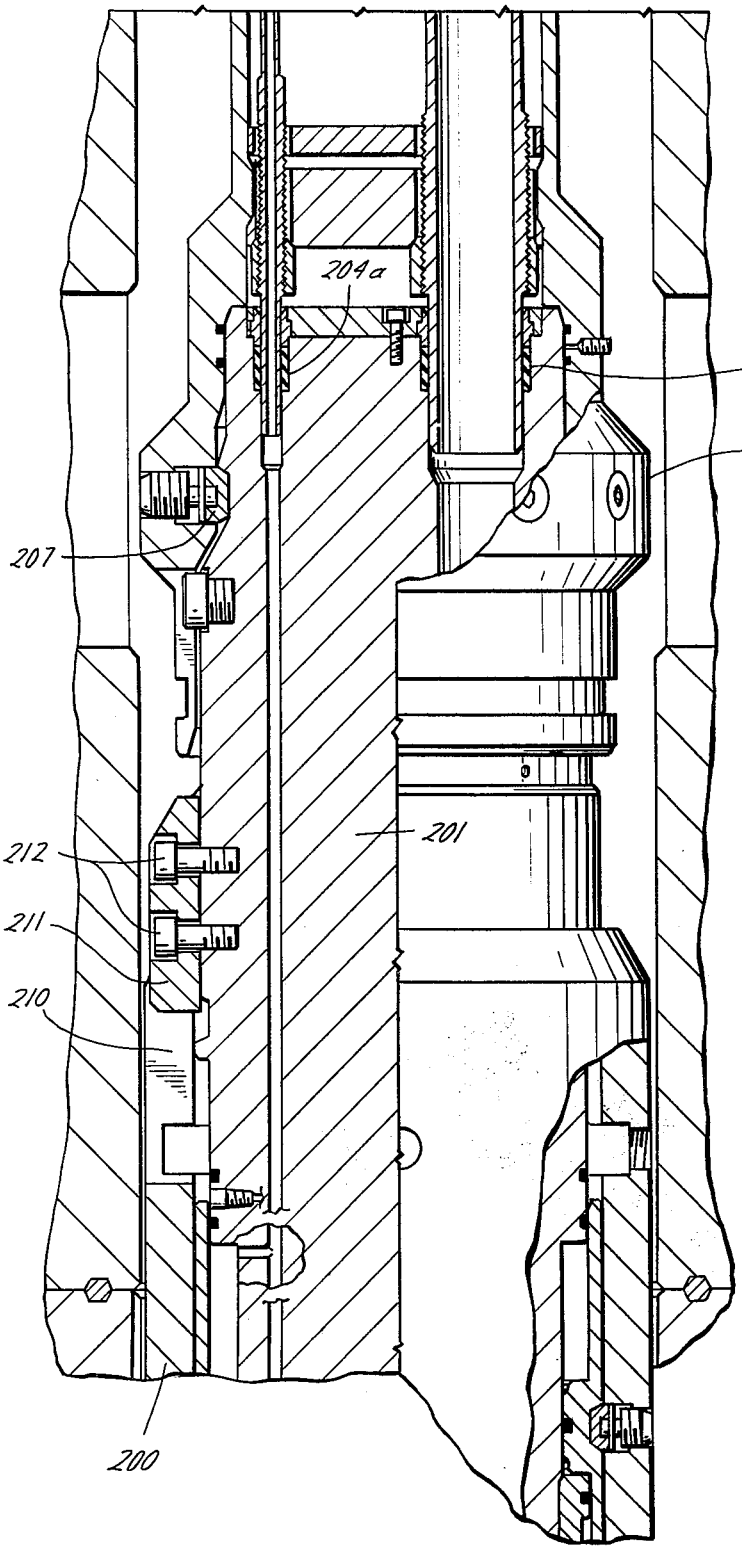
FIG. 8 is an elevation view of the upper end of the running tool.

The upper ends of the tubing passages 203 and the control line 204 are provided with a suitable V-packing, such as **203*a* and 204*a*, respectively, or other seal means which will seal around the sub which is connected to a completion riser 209 as shown in FIG. 8. Also, the upper end of the cylindrical body 201 is provided with recesses 207 for receiving dog screws 208 for connection to a completion riser 209. Also, as shown in FIG. 8, a slot 210 is provided in the outer housing for receiving the alignment key 211 secured to the outer sleeve 200 by means of screws 212. The alignment key permanently aligns the outer sleeve 200 with the inner body 201. The outer sleeve 200 is also provided with spring loaded locating lugs 214 (FIG. 4) which are mounted in suitable openings 215 in the side of the sleeve by retainer plates 216 held by screws 217. Such lugs have upper and lower tapered shoulders 218 and 219, respectively, to facilitate depressing the lugs when engaging the walls of the opening through the connector 24. When the running tool R is rotated to align the lug 214 with the slot 34 in the connector 24, the lug 214 is moved outwardly by the spring 214' into the slot 34 and thus prevents further rotation of the running tool relative to the connector 24**.

Figure 2B:
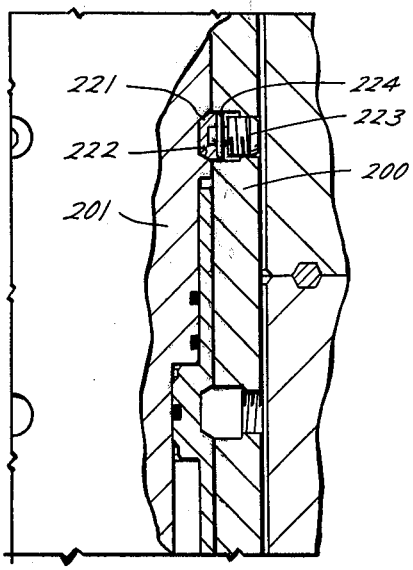
FIG. 2B is a partial fragmentary view of FIG. 2.

In the running position, the outer sleeve 200 and the inner body 201 are locked together, as shown in FIG. 2B, by means of sleeve dogs 221 which are held in place in suitable circumferentially receptacles 222 by means of dog screws 223 that are locked by groove pins 224. The dog screws 223 are placed in circumferentially spaced openings around the outer sleeve 201.

As shown in FIG. 4, a spring loaded orientation latch 230 is mounted in a recess 231 at the lower end of the outer sleeve 200 for engaging the orienting key 130 carried by the tubing hanger body 51. The latch 230 is slidably mounted on a socket screw 233 which has a coil spring 235 for urging the orienting latch 230 downwardly so the latch normally protrudes below the lower face 236 of the outer sleeve 20l. Also, with the inner body 201 locked to the outer sleeve 200 by the dog screws 223, as described above and as shown in FIGS. 2 and 3 of the drawings, the lower end 236 of the upper sleeve is positioned so as to extend below the bottom of the subseal 56 so that the seal is protected by being positioned within the surrounding lower skirt portion of the outer sleeve 200.

Figure 4A:
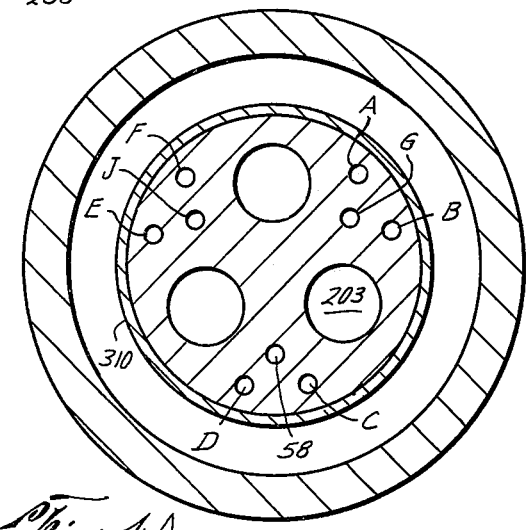
FIG. 4A is a sectional view taken on line 4A—4A of FIG. 4.

FIG. 4A shows the hydraulic control lines, such as 58, A and B as well as the control lines D, E, F, J, etc., which are provided for actuating the running tool R.

As shown in FIG. 5, the inner body 201 is provided with a reduced diameter portion 240 which forms an annular shoulder 241 with the larger diameter cylindrical seal portion 244 thereabove. A pair of O-ring seals 242 and 243 are provided in the cylindrical seal surface 244 above the shoulder 241 and on opposite sides of a fluid conduit passage H which is provided for a purpose to be described herein. Similarly, the inner body is provided with a second reduced diameter seal surface 250 extending downwardly from beneath the port E. Such seal surface 250 is provided with external O-ring seals 251, 252, 253 and 254 which are longitudinally spaced from one another and which are received in suitable external circumferentially extending grooves. As shown, a fluid passage G is provided with a port in the cylindrical surface 250 between the adjacent O-ring seals 251 and 252. Similarly, the fluid passage D is provided with a port between the O-ring seals 252 and 253 and finally, the fluid passage J is provided with a port between the seals 253 and 254. It will be appreciated that each of the fluid passages mentioned herein are formed in the cylindrical body 201 and are connected to a hydraulic fluid source for actuating the running tool as will be described hereinafter.

Disposed in an annular space 260 between the outer sleeve 200 and the inner body 201 is a tubular function piston designated generally 262. The tubular function piston 262 is formed with substantially cylindrical outer surface having an internal upset or shoulder portion 264 near the upper end 265. Such internal shoulder has a plurality of tapered recesses 266 formed therein for receiving the sleeve dogs 271 for locking the function piston 262 and the outer sleeve 200 together in the FIGS. 5–7 retrieval position as will be described hereinafter.

The inner cylindrical surface **265*a* of the upper skirt portion actuator piston is a seal surface for sealing with the O-ring seals 243 and 242. The inner cylindrical surface 267 of the lower skirt portion 268 of the actuator piston 262 is also a seal surface for sealing with the O-ring 269**.

The outer surface 240 of the reduced diameter portion is a cylindrical seal surface for sealing with the O-ring 270 formed in an internal circumferentially extending groove in the inner upset portion 264 of the actuator piston 262.

Beneath the port E, a function cylinder or sleeve 272 extends circumferentially around the reduced diameter portion 250 and the inner surface **272*a* of such sleeve is a seal surface that seals with the O-ring seal 251. The function cylinder 272 has an upper annular shoulder 273 which projects radially outwardly from the body of the function cylinder and carries the O-ring 269. The body of the sleeve or function cylinder 272 also has a second external circumferentially extending O-ring seal 275 a groove near the lower end of the function cylinder which seals with the upper inner sealing surface 280*a* of the primary dog piston 280**.

The upper end of 273 of the function cylinder 272 is positioned adjacent the hydraulic fluid port E and the upset or shoulder formed by the larger diameter portion 240. The lower end of the function cylinder is positioned adjacent the outlet for the passage G. A dog cylinder 290 holds the function cylinder 272 at its desired elevation. The upper edge of the dog cylinder engages the lower edge of the function cylinder and an opening 291 is provided at the upper end of the dog cylinder to vent the port G and similarly an opening 292 is provided in the dog cylinder to vent the passage D and an opening or passage 293 as provided for venting the hydraulic port J. It will be understood that each of these ports is aligned with the adjacent hydraulic port to permit fluid to discharge therefrom. Also, the lower end of the dog cylinder 290 has an annular shoulder 294 which projects radially outwardly from the body of the dog cylinder and has an external O-ring 296 for sealing with the lower skirt of the primary dog piston 280. A cylinder retaining nut 297 is threaded to the cylindrical body 201 for engaging the bottom of the dog cylinder 290 to hold it at the desired elevation. A snap ring 298 is provided beneath the bottom of the threaded ring to hold it against inadvertent movement.

Figure 6:
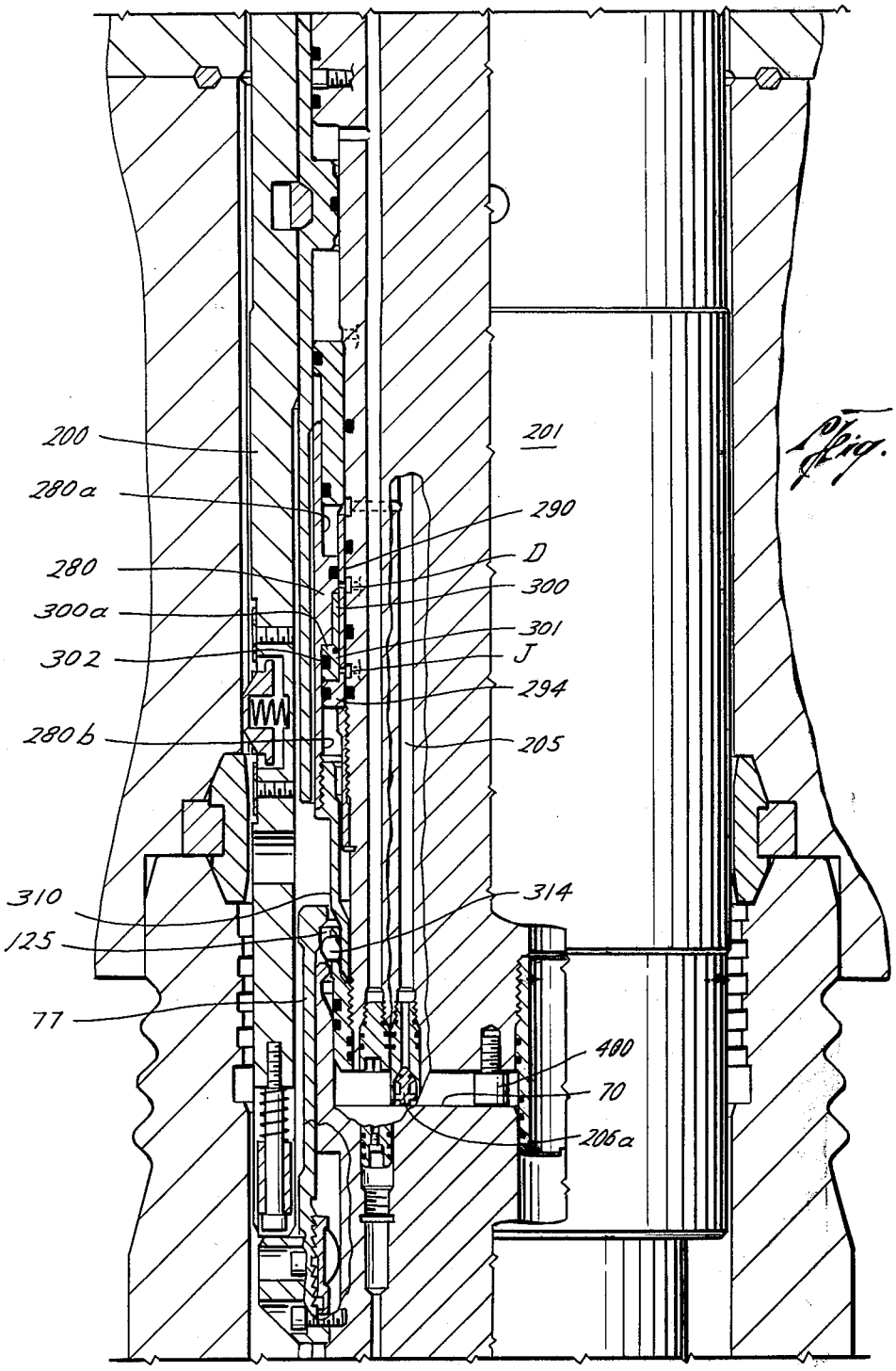
FIG. 6 is a fragmentary enlarged vertical section showing the running tool with the re-entry spacer locked into the tubing hanger.
Figure 7:
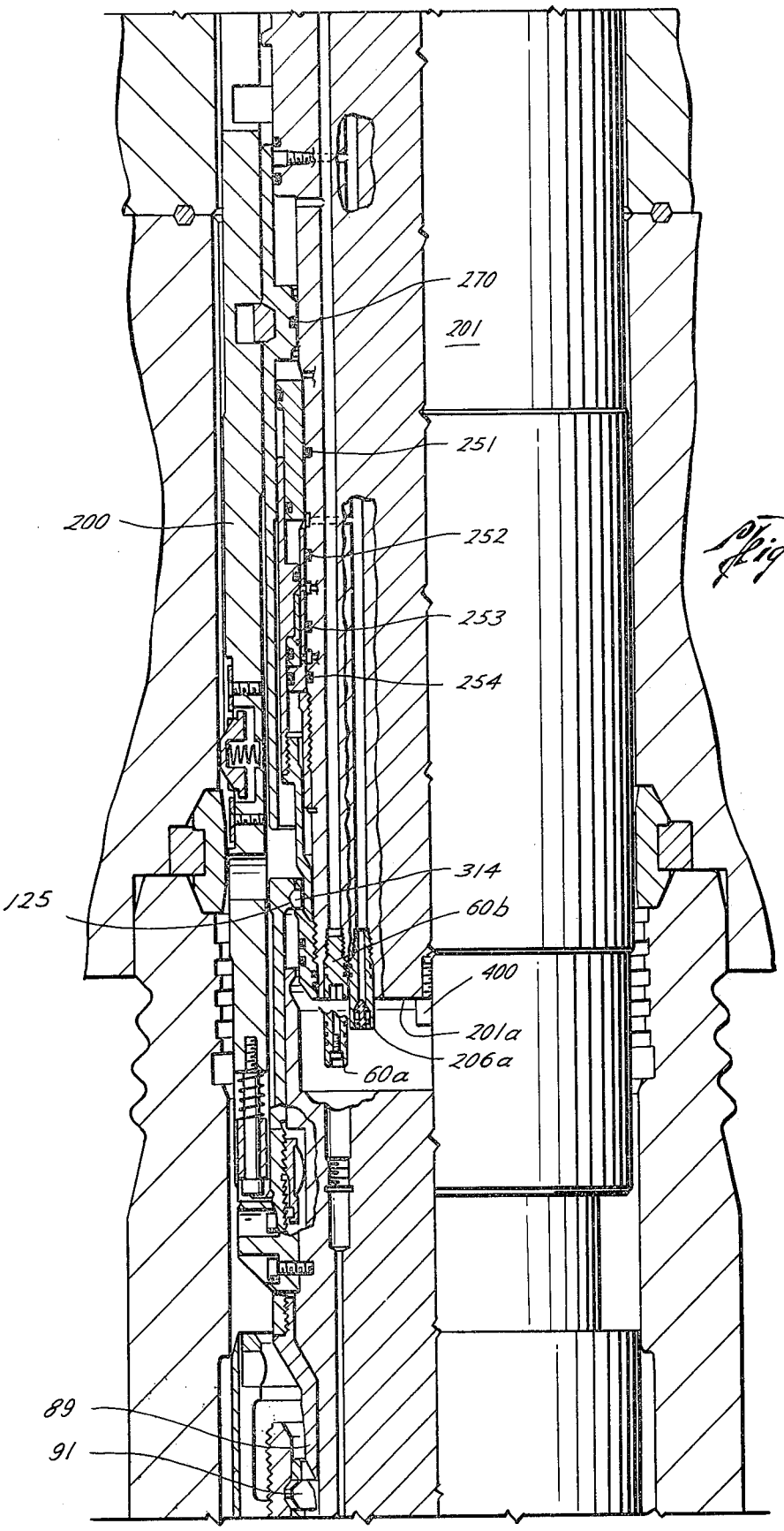
FIG. 7 is a fragmentary enlarged vertical section showing the running tool locked into the tubing hanger and the tubing hanger unlocked from the casing hanger.

As shown in FIG. 6, a secondary dog piston 300 extends around the body 201 between the dog cylinder 290 and the primary dog piston 280. The upper end of the secondary dog piston is shown immediately beneath the port D and its lower end adjacent the upper side of the annular shoulder of the dog cylinder 294. The secondary dog piston also has an outwardly extending annular shoulder 301 with an O-ring seal 302 disposed therein for sealing with the inner seal surface of the lower skirt of the primary dog cylinder 280.

Also as shown in FIG. 6 of the drawings, the primary dog piston 280 is primarily a tubular member having a cylindrical outer surface and an upper inner seal surface **280*a* and a lower cylindrical inner seal surface 280*b*. As shown, the surface 280*b* forms a counterbore in the primary dog cylinder 280 for receiving the dog cylinder 294 and the secondary dog annular shoulder 301. As shown, an inner O-ring seal 300a is provided in the secondary dog piston for sealing with the outer surface of the dog cylinder 294**.

As shown in FIG. 5, extending circumferentially around the lower portion of the body 201 is the dog actuator 310 which is threaded to the lower end of the primary dog piston 280. The dog actuator includes a lower tapered surface 312 which is tapered downwardly and inwardly and adapted to be inserted behind the dogs 314 which are disposed circumferentially around the body 201. As shown, the dogs are carried in a dog retaining ring 316 which is threadedly secured to the lower end of the housing 201. The dogs 314 are provided with an upwardly and outwardly inclined surface 314a which is tapered to receive the downwardly and inwardly tapered surface 312 so that when the dog actuator 310 is moved downwardly into engagement with the inclined surface 314a, it will urge the dogs radially outwardly relative to the dog retaining ring 316, and, as shown in FIG. 3, into the circumferential groove 69 and, as shown in FIG. 6 retrieval position, into the circumferential groove 125 in the upper actuator body 77.

Also, as shown in FIGS. 5 and 6, a re-entry spacer 400 is screwed into the lower end of the central body 201a. Such spacer projects below the bottom of the central body and engages the upper face 70 to align the lock dogs 314 with the groove 125 in the retrieval mode. Also, the extension 60a is provided for connecting the downhole control lines A, B, etc. when the re-entry connection is made.

SUMMARY OF OPERATION

The running tool R is connected to the tubing hanger T at the surface and run in on the running tool R and landed on the seat 40 in the casing hanger C. As shown in FIG. 2, the tubing hanger T is in the landed position in the casing hanger C but not locked-in yet. During the running and landing operation, the inner body 201 is locked to the outer sleeve in the upper position by the dog screws 223 (FIG. 2B). The upper actuator body 77 of the tubing hanger T is locked-in the upper position relative to the cylindrical body 51 by the shear pin 80 carried by the shear dog 75.

Further, the lower end of the inner cylindrical body 201 of the running tool is inserted into the counterbore in the annular skirt 64 at the upper end of the central body 51 of tubing hanger T so it engages the upper central suface or face 70 and close the check valve 206. The subseal 56 is inserted into the counterbore 55 and the control line passage 204 is connected with the control line passage 58 by the control line extension sub 60.

The primary dog piston 280 which carries the dog actuators 310 is driven downwardly by injecting hydraulic fluid through the passage G into the chamber G' beneath the secondary dog piston 272. As shown, the dog actuators 310 are thus inserted behind the dogs 314 to force them radially outwardly into the circumferential lock groove 69 in the upper end of the skirt 64 of the cylindrical body 51.

With the running tool R and the tubing hanger T thus locked together, they are run through the production riser 209 and into the passage in the connector. The running tool R is rotated until the orienting lug 214 is aligned with and inserted into the slot 34. Thereafter, the tubing hanger T is seated on the inclined seat 41 in the casing hanger C. As shown, the seal 108 engages the cylindrical seal surface 41 and the landing ring 113 engages the inclined seat 41.

Hydraulic fluid pressure is applied to the control line F (FIG. 3) and enters the chamber F' and forces the function piston 262 from the running position shown in FIG. 2 downwardly to the locked-in position shown in FIG. 3, causing the lower end of 262a of the function piston to engage the upper flange surface 121 of the upper actuator body 77 to force it downwardly causing shear dog 75 to shear the pin 80. Also, the shear dog 74 is depressed inwardly by the teeth 76a as they ratchet over downwardly pointing teeth on the shear dog 76 as the upper actuator housing moves downwardly. As shown, the lower actuator body 86 which is connected to the upper actuator body 77 is moved downwardly causing the dog actuators 89 to expand the dogs 91 outwardly into the groove 43 in the casing hanger C to thus locking the tubing hanger T in the casing hanger C (FIG. 3).

As shown in FIG. 4 of the drawings, the running tool R has been disconnected from the upper end of the tubing hanger T for retrieval to the surface. This was accomplished by injecting hydraulic fluid through the passage D into the chamber D' to move the primary dog piston 280 upwardly and thus withdrawing the dog actuator 310 from the lock dogs 314 permitting the lock dogs to retract into the recesses in which they are carried in the dog retaining ring 316 and retracting such dogs 314 from locking engagement with the circumferential groove 69 in the upper annular skirt tubing hanger T.

With the dogs thus disengaged, the running tool may be moved upwardly by applying a direct mechanical upward lift thereto to permit it to be retrieved to the drill ship at the surface. It should be noted that during the running and landing operation the bore of the tubing string 53 remains open throughout this operation and the downhole ball valve (not shown) connected to control line passage 58 remains operable.

Thus also, it will be appreciated that the subseal 56 may be disconnected from the counterbore 55 by an upward pull on the running tool R and similarly, the control line 204 may also be disconnected from counterbore 59.

Also, the orienting key 214 in the slot 34 will guide the running tool R in a straight upward direction and prevent any rotational movement of the running tool relative to the tubing hanger during the disconnecting operation.

FIG. 5 shows the running tool in the re-entry mode with the outer sleeve 200 moved downardly relative to the inner body 201 and locked in this extended position with the sleeve dogs 224 inserted into the recesses 266 in the outer surface of the upset portion 264 of the function piston 262. The dogs 224 are held in position by the dog screws 223. Also, as shown in FIG. 5, it will be noted that the lower end of the outer sleeve 200 projects well below the lower end of the seal sub 56 as well as the re-entry spacer 400 and the re-entry extension subs 60a which project below the lower cylindrical body 201 for insertion into control lines A, B and C. As shown, control line F is provided with a check valve 206 which will permit hydraulic fluid to be discharged as will be described.

In this re-entry mode, it will be noted that the primary dog piston 280 and the dog actuators 310 are in substantially the same position as shown in FIG. 4 after being disconnected from the tubing hanger T. That is, the dog actuator 310 is withdrawn and the dogs 314 are retracted into the dog retainer 316. It will be appreciated that in this retracted position, the retainer ring and dogs may be inserted into the counterbore opening at the top of the upper actuator 77 in tubing hanger T. In the re-entry operation, the running tool R is lowered into position in the opening in the connecter 24 and rotated until the orienting key 214 finds the slot 34 and is moved outwardly therein by the spring 214'.

Also, as shown in FIG. 5 of the drawings, the orientation latch 230 is shown engaging the orienting key 130 on the tubing hanger T. When the running tool R has thus been located relative to the tubing hanger T, hydraulic fluid drained from the chamber F' through check valve 60 to thereby permit the cylindrical body 201 to move downwardly and thereby stab the control line re-entry extension sub **60*a* into the passage 59 and the seal sub 56 into the counterbore 55. It will be noted that the re-entry spacer 400 is screwed into an opening in the bottom of the cylindrical body 201 and such spacer engages the upper surface 70 of the tubing hanger body 51 as does the lower end of the check valve 206*a*** in the control line passage G.

As shown in FIG. 6 of the drawings, with the re-entry spacer positioned on the upper surface 70 of the tubing hanger T, the locking dogs 314 are positioned adjacent the groove 125 near the upper end of the upper actuator body 77. Thus, when hydraulic fluid pressure is applied to the control line G and if the check valve **206*a* is properly seated, hydraulic fluid is injected into the chamber G' to move the primary dog piston 262 and the dog actuators 310 attached thereto downwardly to lock the dogs 314 in the groove 125**.

Once the re-entry dogs have been set in the circumferential lock groove 125, hydraulic fluid is next applied to the control line F to fill the chamber F' and raise the cylindrical body 201 upwardly and position the dogs 314 against the upper inclined edge of the circumferential groove 125 in the upper actuator body 77. As shown, a plug 60h is provided in the lower end of control line F.

An upward pull on the running tool R will then move the upper actuator sleeve 77 upward thus causing the shear dog 74 to shear the pin 82 and permit additional upward movement of the dog locking members 89 which allow the dogs 91 into the circumferential lock groove 43 in the casing hanger C to retract into the dog retainer. Additional upward movement of the running tool R will then unseat the tubing hanger from the tapered or inclined seat in casing hanger C and allow the tubing hanger and the tubing associated therewith to be moved upwardly and retrieved from the well.

It will be appreciated that the dogs 314 and 91 are provided with tapered upper shoulders and their respective circumferential locking grooves 69, 125 and 43 are also each provided with an inclined or tapered upper surface to urge the dogs inwardly when moved upwardly against such upper surfaces.

The foregoing disclosure and description of the invention are illustrative and explanatory thereof, and various changes in the size, shape, and materials as well as in the details of the illustrated construction may be made without departing from the spirit and scope of the invention.

I claim:

1. A tubing hanger comprising:

an inner body having a tubing string passage therethrough for connecting a tubing string;

releasable lock means for locking said tubing hanger to a running tool including a shear dog having a shear pin and teeth for engagement by an actuator sleeve surrounding said tubing hanger body to shear said shear pin when said actuator body is moved longitudinally relative to said tubing hanger body.

2. The invention of claim 1, including:

a control line passage extending through said inner body and not in communication with said tubing string passage.

3. The invention of claim 1, including:

a landing ring rotatably mounted on the lower end of said inner body below said locking means for landing on a seat in a casing hanger with a teflon washer disposed between the landing ring and said locking means to facilitate rotation therebetween.

4. A tubing hanger having an inner body adapted to be seated in a casing hanger and having a tubing string passage extending longitudinally therethrough for connecting a tubing string thereto and a longitudinally extending control line passage extending longitudinally therethrough and not in fluid connection with said tubing string for connecting a hydraulic control line for actuating downhole devices independently of said tubing string.

5. The invention of claim 4, wherein said locking means comprises:

a shear dog carrying a shear pin and teeth in said shear dog for engagement with said upper actuator body to shear said shear pin when said actuator body is moved upwardly relative to said inner body.

6. The invention of claim 5, wherein said releasable lock means includes:

a spring loaded lock dog which is retractable to permit shifting of said upper actuator body downwardly from an upper to a lower position relative to said inner body without shearing said shear pin.

7. A running tool for setting and retrieving a tubing hanger in a casing comprising:

an inner body having a longitudinally extending passage therethrough for connecting a tubing string;

latch dogs carried on said inner body and adapted to be moved radially outwardly for latching to a surrounding groove in a tubing hanger for locking the running tool thereto;

first cylindrical piston means carried on said inner body and movable longitudinally relative thereto for engaging said latch dogs and moving them radially outwardly; and hydraulic fluid control passage in said inner body not in fluid communication with said tubing string for supplying hydraulic fluid under pressure to said first cylindrical piston means by moving it longitudinally relative to said inner body.

8. The invention of claim 7, including:

additional hydraulic control passages in said inner body not in fluid communication with said tubing string for moving said first cylindrical piston out of engagement with said latch dogs for disconnecting said running tool from said tubing hanger.

9. The invention of claim 7, including:

second cylindrical piston means carried on said inner body and adapted to be moved longitudinally thereof for engaging an actuator body surrounding a tubing hanger for moving latch dogs on said tubing hanger into latching engagement with a surrounding groove in a casing hanger, said inner body including a control passage extending therethrough not in fluid communication with said tubing string for supplying hydraulic fluid under pressure to move said second cylindrical piston longitudinally of said running tool.

10. A running tool for setting and retrieving a tubing hanger, comprising:

a. an inner body having a longitudinally extending passage therethrough for connecting with a tubing string;

b. an outer sleeve surrounding said inner body and connected thereto;

c. latch means carried by said inner body for latching to a tubing hanger;

d. hydraulic actuated means in said inner body for releasing said latch means to release the tubing hanger from said running tool; and e. a re-entry control line extension connected to the control line passage in said inner body and adapted to be inserted into a control line or receptacle in the tubing hanger to provide hydraulic fluid to a valve connected to said control line when the running tool is re-connected to the tubing hanger.

11. The invention of claim 10, including:

a re-entry spacer for connection to the lower end of the inner body of the running tool to align the expandable dogs with a latch groove in the upper end of the upper actuator body in said tubing hanger whereby the dog actuator can expand the dogs radially outwardly into the locking groove in the upper actuator body to latch the running tool to the tubing hanger on re-entry.

* * * * *